US006242051B1

(12) United States Patent
Zaretsky

(10) Patent No.: US 6,242,051 B1
(45) Date of Patent: Jun. 5, 2001

(54) COATING METHOD USING ELECTROSTATIC ASSIST

(75) Inventor: Mark C. Zaretsky, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/439,390

(22) Filed: Nov. 15, 1999

Related U.S. Application Data

(63) Continuation-in-part of application No. 09/130,507, filed on Aug. 6, 1998, now abandoned.

(51) Int. Cl.[7] ..... B05D 3/14
(52) U.S. Cl. ..... 427/472; 427/420; 427/299
(58) Field of Search ..... 427/324, 326, 427/420, 471, 472, 299

(56) References Cited

U.S. PATENT DOCUMENTS 4,513,683 * 4/1985 Kisler .
4,517,143 * 5/1985 Kisler .
5,432,454 * 7/1995 Durkin .

* cited by examiner

*Primary Examiner*—Fred J. Parker
(74) *Attorney, Agent, or Firm*—Mark G. Bocchetti; Arthur H. Rosenstein

(57) ABSTRACT

A method for electrostatically assisting in coating a liquid composition from a hopper to a web supported by a backing roller, characterized by the steps of a) neutralizing all charges on both surfaces of the web by passing the web through an appropriate electrostatic environment ahead of the coating point, and b) providing a uniform electrostatic field around the backing roller, which field extends through the web to engender an electrostatic "pressure" for urging the liquid composition toward the coatable surface of the substrate at the coating point resulting in an increase in the maximum coating speed achievable without onset of air entrainment at the coating point, improved thickness uniformity of coating, and a reduction in residual charge on the web after coating.

15 Claims, 2 Drawing Sheets

COATING METHOD USING ELECTROSTATIC ASSIST

CROSS-REFERENCE TO RELATED APPLICATIONS

This is a continuation-in-part of application Ser. No. 09/130,507, filed Aug. 6, 1998, entitled "IMPROVED COATING METHOD USING ELECTROSTATIC ASSIST" by Mark C. Zaretsky, now abandoned.

FIELD OF THE INVENTION

The invention relates to methods for coating a liquid composition onto a moving support web, more particularly to methods for coating photographic emulsions onto a moving web of photographic support such as a plastic or resin-coated cellulose web, and most particularly to a method for increasing the speed of emulsion application and for improving the thickness uniformity of applied emulsions by controlling electrostatic charges on the web and coating apparatus.

BACKGROUND OF THE INVENTION

In the manufacture of many commercial products, a liquid composition is applied as a coating to a receptor substrate. In many applications, and especially in photographic films and papers, the requirements for areal uniformity of coated thickness are highly demanding. Limitations on thickness variation of 1% or even less can be required. Density variations will form in the coating and when a uniform exposure is given to different density levels, streaks and non-uniform images are obtained.

Known coating apparatus typically includes a backing roller around which a web to be coated is wrapped and conveyed at a predetermined conveyance speed. A liquid composition is continuously delivered to and reshaped by an applicator, generally known as a hopper, from a jet flow at the applicator inlet into a broad ribbon of substantially uniform thickness at the applicator outlet from which it is dispensed onto the moving web. Typically, such an applicator is positioned either immediately adjacent to the moving web at a distance of typically less than 1 mm, a transverse, dynamic bead of composition being formed therebetween (bead coating), or above the web at a distance of typically several cm, the composition being allowed to fall as a curtain under gravity into continuous contact with the moving web (curtain coating). A liquid composition may be a single layer or a composite layer consisting of a plurality of coating compositions.

In all coating systems, there is an upper speed limit for coating at which the boundary layer of air carried on the surface of the web is no longer squeezed out by the advancing composition at the coating point but rather becomes entrained under the composition, disrupting the uniform application thereof to the web and resulting in unacceptable coating uniformity.

It is well known that electrostatic charging of a coating apparatus by electrifying the surface of the coating roller can be useful in increasing the upper limit of coating speed. See, for example, U.S. Pat. Nos. 3,335,026 issued Aug. 8, 1967; 4,837,045 issued Jun. 6, 1989; and U.S. Pat. No. 4,864,460 issued Sep. 5, 1989. However, the web can have random charge patterns created prior to the location of the ionizers, due to the unwinding and conveyance process as well as corona discharge treatment of the web. As charge nonuniformities on the web when entering upon the charged coating roller are not neutralized, or smoothed, by the charged roller but simply added to the electrostatic field imparted by the roller, the areal charge nonuniformity can result in a corresponding coating nonuniformity.

Methods and apparatus have been proposed to enhance coatability by removal of charge nonuniformities from both surfaces of a web by neutralizing charges on the web ahead of the coating roller. See U.S. Pat. Nos. 3,470,417 issued Sep. 30, 1969; U.S. Pat. No. 3,531,314 issued Sep. 29, 1970; U.S. Pat. No. 3,730,753 issued May 1, 1973; and 5,432,454 issued July 11, 1995. Such proposals avoid the problem of web charge nonuniformities created by processes such as corona discharge treatment but do not deal with the problem of providing an electrostatic assist to enhance web coatability and increase coating speed.

It is also well known that electrostatic charging of a web can be useful in increasing the upper limit of coating speed. For example, a dielectric web carrying a bound polar charge between opposite surfaces thereof can exhibit increased "wettability" and a consequent increase in acceptable coating speed when conveyed around a grounded coating roller. Means for applying such a charge to a web ahead of the coating point are disclosed, for example, in European Patent No EP 390774 issued Jul. 15, 1992; U.S. Pat. No. 4,835,004 issued May 30, 1989, U.S. Pat. No. 5,122,386 issued Jun. 16, 1992, U.S. Pat. No. 5,295,039 issued Mar. 15, 1994; and European Patent Application No. 0 530 752 A1 published Mar. 3, 1993.

Serious problems can arise in using electrostatic assist for coating in processes wherein the web is charged ahead of the coating point. For example, it can be difficult to apply the charge uniformly over the web. Ionizers must be rigorously maintained, and charging webs at high speeds can require prohibitively large and expensive installations. Apparatus and methods have been proposed for correcting the charge nonuniformity that can occur during the charge application process. See, for example, U.S. Pat. No. 4,835,004 and European Patent No. 0 530 752 A1 which propose to control charge uniformity by imposing strict environmental controls around the web. Such controls can be expensive to install and operate and also may be only marginally effective as heat and humidity are used to aid in the electrostatic assist by smoothing the charges and not removing them. This environmental control should not be required. Environmental control, such as heating the web, relies on changes in physical and electrical properties as the web. These changes can limit the choice of webs and/or sorting on these webs.

Further, even when charge has been applied uniformly, the uniformity can be compromised by any of various well known contacts or exposures between the charge application point and the coating point. It has been observed that a significant loss in charge from a charged web surface can occur upon contact with conveyance rollers that typically are conductive and electrically grounded. These rollers may have a surface pattern such as a series of circumferential grooves to provide traction. The charge loss experienced by a charged web surface when conveyed over these rollers occurs in a manner corresponding to the surface pattern. Areal variations in charge on the web when it reaches the coating point typically result in variations in layer thickness and consequent density nonuniformity also corresponding to the surface pattern. None of the prior art discusses this charge loss issue between the charge application point and the coating point.

Further, charge remaining on the web after coating can be a shock hazard to operators and can be a marking or fogging hazard to light-sensitized product later in coating and in finishing.

Thus there is a need for a method for coating a liquid composition to a moving web at high speed whereby the web is rendered substantially discharged ahead of the coating point, and whereby the coating bead or curtain is subjected to a highly uniform electrostatic field widthwise of the web at the point of coating.

SUMMARY OF THE INVENTION

It is a principal object of the invention to provide an improved web coating method whereby a predetermined, uniform electrostatic charge on a coating roller assists in providing a coating having excellent thickness uniformity.

It is a further object of the invention to provide an improved web coating method whereby webs may be coated to an excellent level of uniformity at increased coating speeds.

It is a still further object of the invention to provide an improved, more operationally robust web coating method which is more tolerant of other operational variability.

It is a still further object of the invention to provide an improved web coating method whereby minimal charge remains on a web after coating.

The apparatus and method of the present invention are useful in providing coated substrates having a high level of coated layer uniformity, manufactured at higher substrate coating speeds than would be possible without the invention.

Briefly described, the present invention includes a method for electrostatically assisting in coating, characterized by the steps of a) preparing the web by neutralizing all charges on both surfaces of the web ahead of the coating point by passing the web through an appropriate electrostatic environment, and b) providing a uniform electric charge over the surface of the backing roller at the coating station to create a uniform electrostatic field around the backing roller, which field extends through the web to engender an electrostatic "pressure" urging the liquid composition toward the coatable surface of the substrate at the coating point.

In a preferred method and apparatus in accordance with the invention, a substantially dielectric web to be coated with a liquid coating such as a gelatin-based aqueous emulsion, for example a web formed from polyethylene terephthalate, is first passed through means for dissipating all surface charges on the web. Preferably such means is disposed in the web conveyance path of a coating machine a short distance ahead of the point of entrance of the web onto the coating backing roller. An example of a suitable means for dissipating charges is an ionizer similar to that disclosed in U.S. Pat. No. 3,730,753 issued May 1, 1973 to Kerr, hereby incorporated by reference, wherein the web is exposed sequentially to one or more high positive charges and high negative charges to "flood" pre-existing charge variations on the web and is then discharged. Preferably, the web is also conditioned for coating by removal of residual free charge by treatment, for example, in accordance with the disclosure of U.S. Pat. No. 5,432,454, hereby incorporated by reference.

After being electrically neutralized, the web is entered onto an electrically-isolated backing roller at a coating station wherein a coating hopper provides a ribbon of liquid composition for coating. The hopper is maintained at ground potential, and the roller is maintained at a predetermined DC potential, either positive or negative, with respect to ground, creating an electrostatic field around the roller. The electrostatic field exerts an electrostatic force which acts through the web to draw the emulsion against the web. The practical result is enhanced apparent "wettability" of the web surface and an increase in the maximum coating speed achievable without onset of air entrainment at the coating point.

BRIEF DESCRIPTION OF THE DRAWINGS

The foregoing and other objectives, features, and advantages of the invention will be apparent from the following more particular description, including the presently preferred embodiment of the invention, as illustrated in the accompanying drawings in which.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE INVENTION

Figure 1:
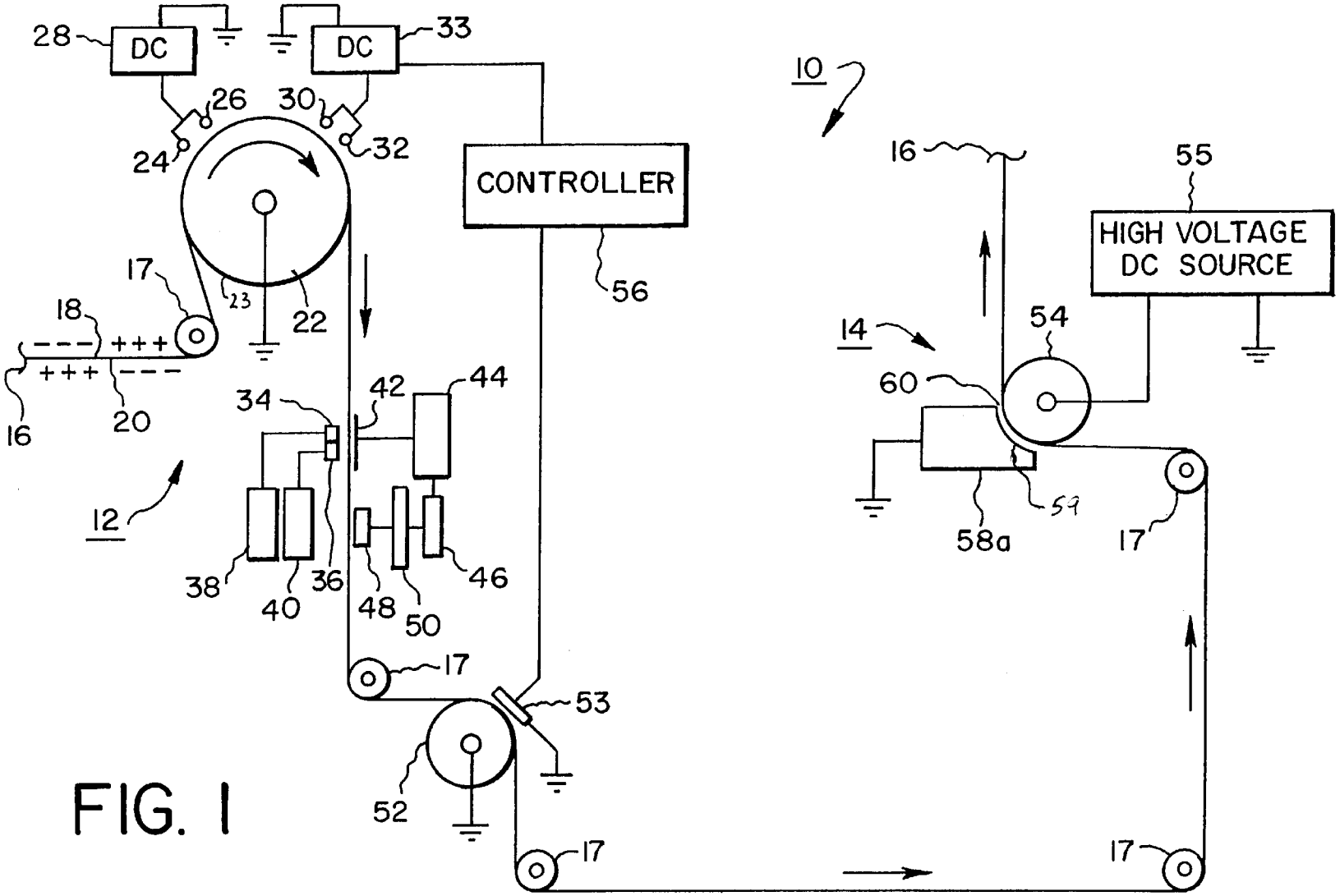
FIG. 1 is a schematic cross-sectional view of an apparatus for discharging a web and electrifying the coating backing roller prior to bead coating of the web in accordance with the invention.

Referring to FIG. 1, a first embodiment 10 of an electrostatic coating assist apparatus for coating a liquid composition to a web which can be coated with a non-light sensitive coating or uncoated in accordance with the invention includes a web charge-elimination section 12 and an electrified coating section 14 for bead coating of the web.

A continuous web 16 having first and second surfaces 18,20, is supplied to section 12 from a conventional unwinding and conveyance apparatus (not shown) and may be conveyed conventionally through the apparatus on generic rollers 17. Web 16 may be formed of any substantially non-conductive material including, but not limited to, paper, plastic film, resin-coated paper, and synthetic paper. Examples of the material of the plastic film are polyolefins such as polyethylene and polypropylene; vinyl copolymers such as polyvinyl acetate, polyvinyl chloride, and polystyrene; polyamide such as 6,6-nylon and 6-nylon; polyesters such as polyethylene terephthalate, and polyethylene-2 and -6 naphthalate; polycarbonate; and cellulose acetates such as cellulose diacetate and cellulose triacetate. The web may carry one or more coats of subbing material on one or both surfaces. The resin employed for resin-coated paper is typically a polyolefin such as polyethylene.

Web 16 may have patches of electrostatic charges disposed randomly over one or both surfaces 18,20. In Section 12, charges on the web are neutralized. Various methods and apparatus known in the art, including but not limited to those disclosed in the patents recited hereinabove, may be suitable for charge removal in accordance with the invention such as the use of DC ionizers, AC ionizers or conductive brushes.

In a presently preferred embodiment, web 16 is wrapped and conveyed around a grounded, conductive backing roller 22 with web surface 20 in intimate contact with the conductive surface 23 of roller 22. Web surface 18 is exposed to negatively charged electrodes 24,26 which "flood" a large amount of negative charges onto surface 18. Electrodes 24,26 may be electrically connected to the negative terminal of an adjustable 0 to −20 kV, 0 to −15 mA source 28 of DC potential. Grounded roller 22 acts as a counter electrode for electrodes 24,26.

One or a set of electrodes can be electrically connected to a negative terminal and the other electrode or set of electrodes can be electrically connected to a positive terminal.

As web 16 is advanced along roller 22, it moves beneath electrodes 30,32 which may be electrically connected to the positive terminal of a DC potential source 33 similar to source 28. Electrodes 30,32 deposit a large amount of positive charges onto web surface 18 which can be used to neutralize the negative charges previously imparted to this surface by electrodes 24,26. Grounded roller 22 at this point finctions as a counter electrode for electrodes 30,32.

In the preferred embodiment, web 16 is conveyed about grounded roller 52 so that web surface 20 is in intimate contact with roller 52, the opposing web surface 18 being exposed to an induction probe 53 (such as a non-contacting electrostatic voltmeter) of a feedback control system comprising probe 53 and controller 56, which controller is responsive to the level of charge sensed by probe 53 and automatically adjusts the level of charge applied by DC source 33 to electrodes 30,32 to control to a desired setpoint. This setpoint may be set to zero so as to minimize the steady-state charge on surface 18, or to a non-zero level so as to provide some electrostatic assist for the coating process.

The just-described electrostatic web treatment typically is sufficient to completely control the charge distribution on surface 18 of the web and some of the charge distribution on surface 20. However, some webs may retain an unacceptable level of residual charge on surface 20 which also must be removed.

Figure 2:
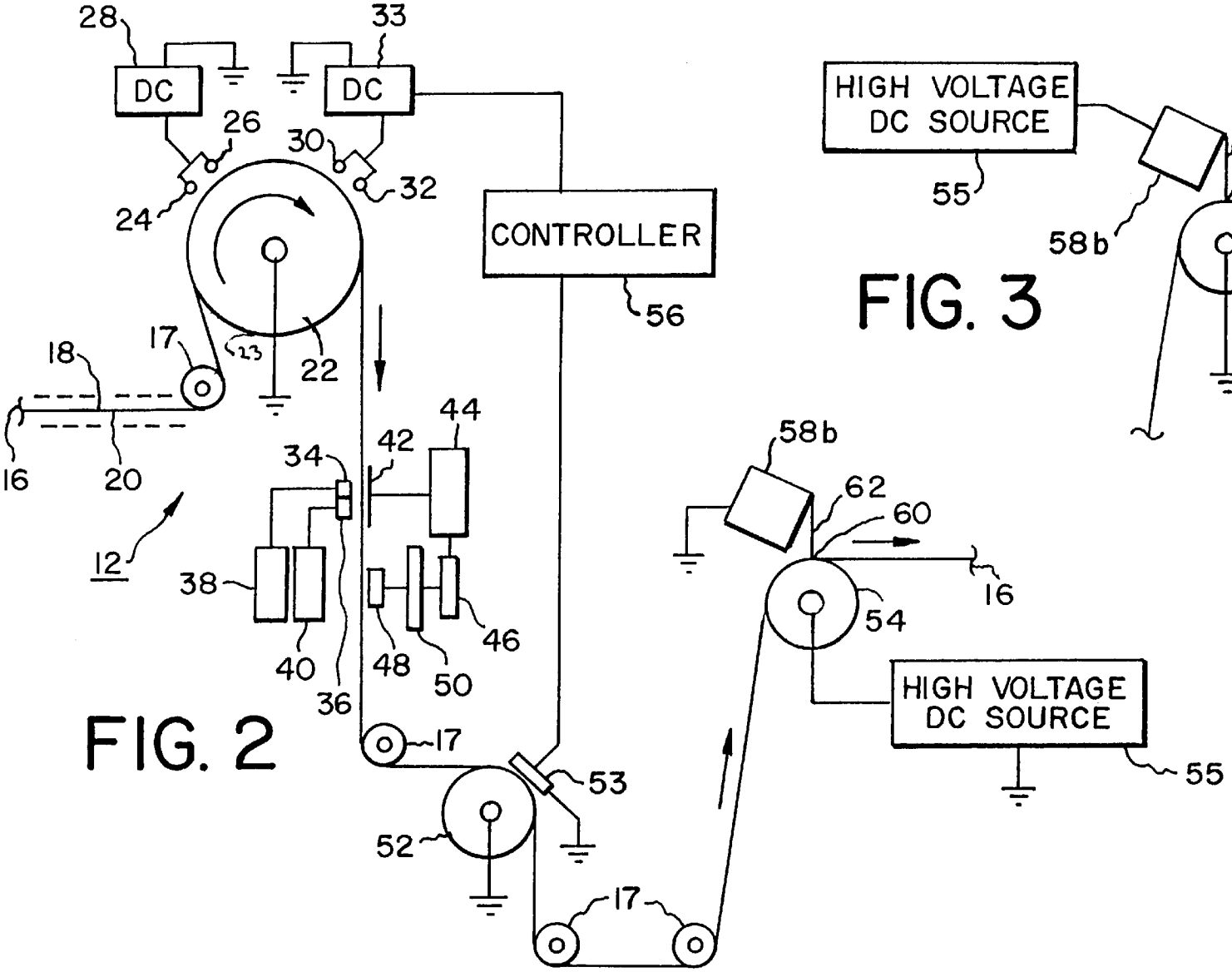
FIG. 2 is a schematic view like that in FIG. 1, shown for curtain coating of the web.

As shown in FIGS. 1 and 2, after leaving roller 22, web 16 may be passed by two fixed voltage or fixed DC current ionizers 34,36 which are mounted near and facing surface 20 of web 16 on a free span of travel. The ionizers 34,36 are mounted so that the central axis of each ionizer lies parallel to the web in the transverse direction of the web. Each ionizer is electrically connected to a separate DC high voltage power supply 38,40. A conductive plate 42 which is electrically isolated from ground is positioned opposite ionizers 34,36 and facing surface 18 of web 16. Plate 42 can be of various shapes, designs, constructions, or materials, including both solid materials and screens, but plate 42 should incorporate at least a layer of conductive material that can act as an equipotential surface to attract charge from ionizers 34,36. A controllable bipolar high voltage source 44 is electrically coupled to plate 42 to deliver voltage to the plate over a wide range of positive and negative voltages. A feedback control system 46 may have a sensor 48 (such as a non-contacting electrostatic fieldmeter) or sensor array responsive to the mean charge density residual on the web after treatment by the ionizers. Source 44 may be adjusted manually to adjust the voltage level on plate 42 so that the plate voltage increases in the same polarity as a direct function of the residual charge density on the web. Preferably, such adjustment is controlled automatically by an electronic controller 50 to minimize the steady-state residual charge on surface 20, preferably near or at zero.

As shown in FIGS. 1 and 2, in section 14 an electrically-isolated coating backing roller 54 is electrically connected to a high voltage DC source 55 to place a high potential on the surface of backing roller 54, for example, from 0.1 kV to 5 kV and preferably 1 kV, creating a standing electric field around roller 54. Coating hopper 58 (which may be a bead coating hopper as 58*a* in FIG. 1 or a curtain coating hopper as 58*b* in FIG. 2 or an extrusion coating hopper, as is well known in the art) is electrically grounded. Air pressure within the bead coating hopper can be varied with the use of a vacuum trough 59. Web 16 is entered upon and wrapped partially around roller 54. The angle of wrap which may be from 45° to 200° includes coating point 60.

Figure 3:
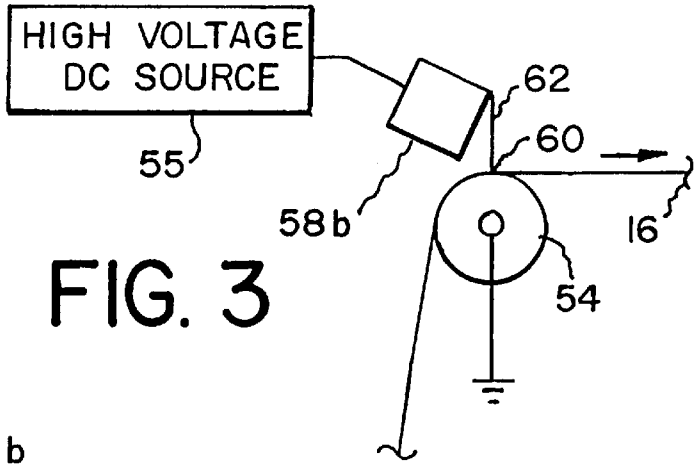
FIG. 3 is a schematic view like that in FIG. 2, showing the coating hopper as being electrified and the coating backing roller as being grounded.

An identical electrostatic attractive force at the coating point may be generated by exchanging the roles of the coating roller and hopper, as shown in FIG. 3, such that the roller is grounded and the hopper is electrified. Because photographic compositions typically are electrically conductive, in such a configuration the entire delivery system must be electrically isolated to maintain the desired potential at the coating point. Further, there is increased risk of electric shock to operating personnel, and of fogging of product from inadvertent discharges. Therefore, in the preferred embodiment the hopper is grounded and the coating roller is electrified.

A further benefit of coatings in accordance with the invention is that little or no net charge is applied to the web after the charge-elimination section, and thus the coated web carries substantially little or no charge on either side of the web upon leaving the coating station.

The following example shows unexpected beneficial results obtained when a web to be coated is first completely neutralized and then a coating applied using electrostatic assist as supplied by a voltage on the coating roller as opposed to part or all of the electrostatic assist supplied by depositing charge on the web to be coated.

EXAMPLE

An aqueous composition was bead coated to a web of polyethylene coated paper 0.25 mm thick being conveyed at a speed of 1.5 m/s on a backing roller with a diameter of 10 cm. Web conveyance rollers 17 had relieved surfaces consisting of circumferential grooves with a nominal groove depth (in the radial dimension) of 0.05 mm, a nominal width of 0.43 mm and a nominal pitch of 1 groove/mm. The aqueous composition consisted of: 1) a bottom layer having a viscosity of about 23 cP and a wet laydown of about 30 $g/m^2$, containing about 5% gelatin and surfactants, as well as carbon black, and 2) a top layer having a viscosity of about 60 cP and a wet laydown of about 26 $g/m^2$, containing about 13.5% gelatin and surfactants. The application hopper coating hopper was spaced about 125 $\mu$m from the web and the level of air pressure in the vacuum trough was nominally 200 Pa.

The charge on the web, as controlled by charge-elimination section 12, was varied between levels of 0, 280 and 670 volts. Similarly, the level of voltage imposed by source 55 on coating roller 54 was varied between 0, 280 and 670 volts. The coating uniformity was examined visually for the appearance of groove lines in the coating corresponding to the 1 groove/mm pattern on the web conveyance rollers. The coating uniformity was also captured digitally and a power spectrum analysis was performed. The power spectrum rms density value at a spatial frequency of 1 cycle/mm, indicative of the coating non-uniformity, was recorded. The results are tabulated below.

| Trial | Charge on Web | Voltage on Roller | Visual Observation | Power Spectrum @ 1 cycle/mm (rms density) |
|---|---|---|---|---|
| 1 | 0 V | 0 V | No coating | — |
| 2 | 680 V | 0 V | Strong groove lines | 1.2E-3 |
| 3 | 280 V | 280 V | Moderate groove lines | 5.5E-4 |
| 4 | 0 V | 680 V | No groove lines | 1.5E-4 |

In trial 1, with no electrostatic assist provided, no stable coating was obtained. In trials 2, 3 and 4, with electrostatic assist provided, a stable coating was formed, demonstrating the benefit of this process with respect to a more operationally robust web coating method In trial 2, with all the electrostatic assist provided by depositing charge on the web upstream of the coating roller, a significant loss of charge in a pattern-wise fashion corresponding to the grooves on the web conveyance rollers and due to face side contact of the charged web with these rollers, has resulted in a significant coating non-uniformity. This is observed visually and confirmed by the large rms density in the power spectrum. In trial 3 this charge loss and concommitant coating non-uniformity has again occurred, though to a lesser extent due to less charge being initially deposited upon the web and more of the electrostatic assist being provided by the voltage on the coating roller. Note that the power spectrum rms density is roughly one-half the level of trial 2. In trial 4, with all the electrostatic assist provided by voltage on the coating roller and the web charge only being neutralized by charge-elimination section 12, no coating non-uniformity is observed. Note that the power spectrum rms density is an order of magnitude lower than in trial 1 and is comparable to the background noise level for rms density at other spatial frequencies.

The invention has been described in detail with particular reference to certain preferred embodiments thereof, but it will be understood that variations and modifications can be effected within the spirit and scope of the invention.

| PARTS LIST | |
|---|---|
| 10 | first embodiment apparatus |
| 12 | charge-elimination section |
| 14 | electrified coating section |
| 16 | continuous web |
| 17 | web conveyance rollers |
| 18 | first web surface |
| 20 | second web surface |
| 22 | conductive backing roller in 12 |
| 23 | conductive surface of 22 |
| 24 | first negative electrode |
| 26 | second negative electrode |
| 28 | DC source to drive 24,26 |
| 30 | first positive electrode |
| 32 | second positive electrode |
| 33 | DC source to drive 30,32 |
| 34 | first DC ionizer |
| 36 | second DC ionizer |
| 38 | power supply for 34 |
| 40 | power supply for 36 |
| 42 | conductive plate |
| 44 | bipolar high voltage source |
| 46 | feedback control system |
| 48 | sensor |
| 50 | electronic controller |
| 52 | grounded roller |
| 53 | induction probe |
| 54 | coating backing roller |

-continued

| PARTS LIST | |
|---|---|
| 55 | high voltage DC source |
| 56 | controller |
| 58 | coating hopper |
| 59 | vacuum trough |
| 60 | coating point |
| 62 | curtain of coating composition |

What is claimed is:

1. A method for coating a liquid composition to a coated or uncoated first surface of a web having first and second surfaces, the web being conveyed along a path through an apparatus for coating, and the composition being applied to the first surface at a coating point in the conveyance path, comprising the steps of:

a) neutralizing electrostatic charges on the first and second surfaces of the web before a coating point;

b) conveying the web after the neutralizing step over at least one conveyance roller having a relieved surface;

c) delivering the electrostatically neutralized web to the coating point in the apparatus for coating;

d) generating a uniform electrostatic field at the coating point by establishing a voltage differential between a backing roller and a coating hopper of from about 0.1 kV to not more than about 1 kV; and e) coating the web at the coating point yielding a uniform electrostatic assist.

2. A method in accordance with claim 1 wherein said neutralizing step is carried out with the assistance of a first negatively or positively-charged electrode or set of electrodes and a second charged opposite to the first electrode or set of electrodes, each being spaced apart from a grounding means, comprising the step of passing the web between the grounding means and the first and second electrodes, the second surface of the web being in contact with the grounding means, to remove charges from the first surface of the web.

3. A method in accordance with claim 2 wherein the grounding means is a grounded conductive roller.

4. A method in accordance with claim 1 wherein said neutralizing step is carried out with the assistance of first and second DC ionizers of opposite polarity, each being spaced apart from a conductive means, comprising the step of passing the web between the conductive means and the first and second DC ionizers to remove charge from the second surface of the web.

5. A method in accordance with claim 1 wherein said neutralizing step is carried out with the assistance of first and second AC ionizers of opposite polarity, each being spaced apart from a conductive means, comprising the step of passing the web between the conductive means and the first and second AC ionizers to move charge from the second surface of the web.

6. A method in accordance with claim 1 wherein said neutralizing step is carried out with the use of conductive brushes.

7. A method in accordance with claim 4 wherein the conductive means is maintained at a voltage other than zero by a voltage control means electrically connected to the conductive means.

8. A method in accordance with claim 7 wherein the voltage control means includes a bipolar high voltage source and a charge sensor connected to the source.

9. A method in accordance with claim 1 wherein said delivering step is carried out with the assistance of a coating backing roller and a coating hopper spaced apart from the backing roller, comprising the step of passing the web around a partial wrap in contact with the backing roller and past the coating hopper.

10. A method in accordance with claim 9 wherein the coating roller is maintained at a voltage other than zero by a voltage control means electrically connected to the coating roller and wherein the coating hopper is grounded.

11. A method in accordance with claim 9 wherein the coating hopper is maintained at a voltage other than zero by a voltage control means electrically connected to the coating hopper and wherein the coating roller is grounded.

12. A method in accordance with claim 9 wherein the coating hopper is selected from the group including bead coating hopper, curtain coating hopper, and extrusion coating hopper.

13. A method in accordance with claim 1 wherein said neutralizing step is carried out with the assistance of a first charged electrode and a second oppositely charged electrode, each being spaced apart from a grounding means, comprising the step of passing the web between the grounding means and the first and second electrodes, the second surface of the web being in contact with the grounding means, to remove charges from the first surface of the web.

14. A method for coating a liquid composition from a hopper to a first surface of a web having first and second surfaces, the web being conveyed along a path through an apparatus for coating against a backing roller at a coating point, comprising the steps of:

a) neutralizing electrostatic charges on first and second surfaces of the web ahead of the coating point by application and removal of negative and positive electrostatic charges;

b) delivering the electrostatically neutralized web to the coating point in the apparatus for coating;

c) applying a uniform electrostatic force to the liquid composition as the liquid composition reaches the coating point by establishing a voltage differential between the backing roller and a coating hopper; and d) coating the liquid composition onto the web yielding a uniform electrostatic assist.

15. A method in accordance with claim 14 wherein one of the backing roller and the coating hopper is maintained at electrical ground and the other of the backing roller and the hopper is maintained at a predetermined voltage of either polarity.

* * * * *